US011202936B1

(12) United States Patent
Levy

(10) Patent No.: US 11,202,936 B1
(45) Date of Patent: Dec. 21, 2021

(54) INLINE DEFLECTING SWIM FIN

(71) Applicant: Peter L. Levy, San Francisco, CA (US)

(72) Inventor: Peter L. Levy, San Francisco, CA (US)

( * ) Notice: Subject to any disclaimer, the term of this patent is extended or adjusted under 35 U.S.C. 154(b) by 0 days.

(21) Appl. No.: 17/234,389

(22) Filed: Apr. 19, 2021

(51) Int. Cl.
*A63B 31/11* (2006.01)

(52) U.S. Cl.
CPC ..... *A63B 31/11* (2013.01)

(58) Field of Classification Search
CPC ..... A63B 31/11
USPC ..... 441/61, 62
See application file for complete search history.

(56) References Cited

U.S. PATENT DOCUMENTS 1,061,214 A * 5/1913 Bys ..... B61B 13/04 104/119
1,896,373 A * 2/1933 Roberts ..... A63B 31/14 441/62
3,830,189 A * 8/1974 Yamanaka ..... B63B 34/56 441/62
5,362,268 A * 11/1994 Nordbeck ..... A63B 31/11 441/64
6,843,693 B2 * 1/2005 McCarthy ..... A63B 31/11 441/64
2011/0014830 A1 * 1/2011 Lan ..... A63B 31/11 441/64

* cited by examiner

*Primary Examiner* — Anthony D Wiest
(74) *Attorney, Agent, or Firm* — Walt Froloff

(57) ABSTRACT

A foot inline deflecting swim fin with hinge coupled to a two-leaf-blade fin with embedded channel-hinge with leaves free to rotate from a perpendicular fluid flow configuration upon power stroke to parallel fluid flow configuration upon an upstroke. The hinge-leaf blade will have pivot stops, limiting leaf rotations to accommodate the two stroke swim propulsion, upstroke and power stroke. An embedded unitary elastomeric hinge having integrated channel with channel limiter stops is disclosed.

12 Claims, 6 Drawing Sheets

INLINE DEFLECTING SWIM FIN

BACKGROUND

Field of the Invention

The present invention relates generally to swim fins and more particularly, to devices which attach to the feet of a swimmer to help create propulsion from a kicking motion water deflecting fin having a reduced drag profile.

Background of the Invention

Swim fins of all kinds have existed since mankind discovered the advantages of aquatic propulsion. Most current swim fin designs have inherent inefficiencies and for various reasons. Fin designs typically have the blade flex or bend around a transverse axis to the blade or foot. Reduced angles of attack help swimmer to generate lift or propulsive power on both light and hard kicking strokes.

A swim fin's blade is designed flex or bend generally on a transverse axis so that the blade's angle of attack is reduced under the exertion of water pressure drag against an up stroke. Swim fin propulsion includes essentially two strokes, the upstroke, blade front pushes into the moving direction against the flow, and the power stroke whereby the blade back pushes fluid away to provide a reaction force propelling the swimmer forward.

Although blades are made for the most part somewhat flexible, their material properties are relatively stiff so that the blade has sufficient bending resistance to enable the swimmer to push against the water on the power stroke without excessively deflecting the blade on the transverse axis and creating drag on the upstroke.

But if the blade bends too far, then the kicking energy is wasted on deforming the blade since the force of water applied to the blade is not transferred efficiently back to the swimmer's foot to create forward progress. This is a problem if a swimmer wishes to increase propulsion in emergency situations. If the blade bends too far on a hard kick, the swimmer will have difficulty achieving high propulsion. Therefore fins are generally made sufficiently stiff to not bend to an excessively low angle of attack during hard and strong kicking stokes.

Thus the current swim fin designs with flex or bend on the transverse axis have tradeoffs. A fin's blades can be too stiff during slower cruise speeds in order to permit effectiveness at higher speeds, or fins they are flexible and easy to use at slow speeds but lack the ability to hold up under the increased stress of high speeds. Fins that that are stiff enough to not over deflect during high speeds will create muscle strain, high exertion, discomfort, and increased air consumption during the majority of the time spent at slow speeds.

Fin flexibility from material properties become a important issue in order to create a desirable balance using the transverse axis flexing blades because significantly rigid materials within load bearing on the power stroke must also be sufficiently flexible to reduce drag on an up stroke as drag against a flat plate geometry is the highest. Some transverse axis bending fin designs use ribs, stiffeners or blade cross section variable thickness to control deflection under product acceptable design conditions. The ribs generally tapered depending on the variable rigidity needed and extend from the blade foot end to the blade distal end tip, used in optimizing fin design.

In some fin designs, soft and highly extensible materials are not used to provide load bearing structure and instead, only highly rigid materials are used that have blade elongation ranges that are typically used for the hardest kicking strokes.

Some fin designs attempt to achieve consistent large scale blade deflections by connecting a transversely pivoting blade to a wire frame that extends in front of the foot pocket and using either a yieldable or non-yieldable chord that connects the leading edge of the blade to the foot pocket to limit the blade angle. This design requires the use of additional parts that increase difficulty and cost of manufacturing and chances for breakage from wear. Some of these designs use metal parts that are vulnerable to corrosion and also add undesirable weight.

What is needed are swim fins that reduce drag through the water on an up stroke yet provide the maximum propulsion on the power stroke without the blade profile change affecting the balance. What is needed are fin designs which decouple the drag and power profiles tradeoffs, where the upstroke drag is reduced without affect to the fin power stroke profile.

Some fin designs use longitudinal load bearing ribs for controlling blade deflections around a transverse axis The blade's angle of attack creates drag in the up stroke and lift on the power stroke which differ significantly for the relatively light to the hard kicking strokes. These fins use substantially longitudinal load bearing support ribs to control the degree to which the blade is able to bend around a transverse axis.

The ribs usually extend vertically above the upper surface of the blade and/or below the lower surface of the blade and taper from the foot pocket toward the trailing edge of the blade. Therefore deflection across the transverse axis is proportional to stress, or load placed on the rib on the power stroke. A light kick produces a minimal blade deflection, a moderate kick produces a moderate blade deflection, and a hard kick produces a maximum blade deflection. But regardless the blade deflection on the power stroke, the drag forces produced in the up stroke are proportional to the blade area perpendicular to the flow. What is needed are blades that can change the drag area profile, to reduce the energy wasted by the swimmer's kick on the performance of forward propulsion.

Blade ribs are typically designed to control the blade's degree of bending about the fin transverse axis under load stroke conditions. Because of the need for the blade to not over deflect during hard kicking strokes, the ribs fins currently used are relatively hard elastomeric or thermoplastic material calculated and made to resist bending to the degree necessary for optimal stroke power. This prevents the blade from deflecting on the transverse axis sufficiently during a light kick but which adds significantly to the drag profile.

Higher load kicks on the power stroke produce larger deflections for the power stroke and moderate drag profiles, while lower loads produce smaller deflections and high drag profiles. Transverse axis bending fins cannot achieve both high performance power stroke and low profile drag on the up stroke simultaneously without more elaborate mechanisms to mediate the material properties for all propulsion power strokes and up strokes.

New materials have allowed that fins use fiber reinforced thermoplastics to shorten elongation ranges for high loading conditions and these materials typically have insignificantly small compression ranges. Some fins use rubber ribs which have harder rubbers with large cross sections to stiffen the blades for power but that under deflect during light kicking strokes. What is needed is a fin that is high performance on the power stroke for hard and soft kicks, yet low drag on the widely varying soft to hard kick upstroke loads.

What is needed are longitudinal load bearing blade/ribs/fin shapes that are allow blade to reach high levels of specific minimum and maximum reduced angles of attack profiles that are desired at slow swimming speeds and maximum reduced angles of attack blade surfaces that are desired at high swimming speeds along with an efficient and effective method for achieving these minimum and maximum angles with minimum drag profiles regardless of swimming speeds Other fin design methods use materials that have good flexibility and memory but have relatively low ranges of elongation. Elongation is considered to be a source of energy loss while highly inextensible thermoplastics such as EVA, thermoplastic elastomer compositions and hi-tech composites containing materials such as graphite and fiberglass are considered to be state of the art for creating snap back qualities. Still the issue of different power strokes and drag profiles persists and is not solved by material properties alone. What is needed are flexible variable material property solutions along with blade design for reduced drag for relaxed to hard stroke propulsion.

The Drag Factor

The drag force, $F_d$, or drag is proportional to cross-sectional area, relative velocity squared, density of the fluid and a shape-dependent drag coefficient $C_d$:

$$F_d = \rho v^2 C_d A/2$$

Where:

$F_d$=drag force $\rho$ =fluid density v=speed of the object relative to the fluid $C_d$=drag coefficient (dimensionless)

A=cross sectional area

In fluid dynamics, drag is a type of friction, or fluid resistance force acting opposite to the relative motion of any object moving with respect to a surrounding fluid. Unlike other resistive forces, such as dry friction, which are nearly independent of velocity, fluid drag force depends on relative velocity of fluid to object. Drag force is proportional to the velocity for a laminar flow and the squared velocity for a turbulent flow. Most flow past a fin will be outside of the laminar regime. Even though the ultimate cause of a drag is viscous friction, the turbulent drag is independent of viscosity. Drag forces always decrease fluid velocity relative to the solid object in the fluid's path and hence create work or lost effort.

A swim fin has basically two strokes, an upstroke and a "down" or power stroke. The upstroke pushes against the fluid to obtain positional purchase so that the power stroke can push fluid away from the blade and create a propulsive force to move the swimmer.

The drag coefficient in the current swim fins is probably the largest drag coefficient on the shape profile scale, providing a flat plate cross-sectional or cube body resistance to flow, shown in FIG. 1 Measured Drag Coefficient Chart. A blade will flex respectively about a transverse axis to provide a power stroke position but maintain a large relative flow area perpendicular to the flow. The Drag Coefficient chart FIG. 1 shows that the prior art suffers the flat plate or largest drag coefficient of any shape traveling relative to a fluid. This already large drag factor is multiplied by the largest cross sectional area factor of a such a shape because of bending about the transverse axis does not reduce the fluid interaction area in any appreciable way. These two factors are responsible for most of the drag and hence work required for the stroke, all other parameters, fluid density and velocity, held constant.

What is needed are fin blades with small drag blade bending area geometry and with low drag coefficient profiles.

SUMMARY

The present invention discloses an inline foot axis deflecting swim fin having a foot component with a swim fin blade coupled to the foot component, and fin blade having an embedded hinge aligned with the foot axis. The embedded hinge is coupled to at least one leaf, the hinge disposed between the foot component and a blade tip center, with the leaf(s) pivotably coupled to the hinge and free to rotate from a perpendicular fluid flow upon power stroke to parallel fluid flow for an upstroke. The hinge-leaf will have pivot stops, limiting leaf rotations from substantially parallel to a substantially perpendicular impinging flow direction, such that the swim fin provides maximum fluid displacement on the power stroke and encounters minimum fluid drag upon leaf rotation parallel to flow on the up stroke. The embedded hinge can be made from a set of hinges including Barrel hinge, Butt hinge, Butterfly, Case hinge, Concealed hinge, Flag hinge, H hinge, Pivot hinge, Self-closing hinge, Bearing hinge and Spring hinge.

In other embodiments with the hinge aspects, an embedded unitary elastomeric hinge having at least one channel with integrated limiter stops within the channel rotatably coupled laterally to at least one swim fin blade leaf disposed along the channel can be made. The channel can have a cross section rotation limiting stop mechanism having a two jaw stop protrusions across a gap, jaw stop protrusions coupled by a isomeric hinge material cavity cross section, channel cross section forming a flexible channel cavity along the hinge axis with the protruding jaw stop gap flexing open on fin blade up stroke to provide hinge flexure without exceeding material elasticity properties and closing to maintain leaf-hinge position perpendicular to the flow direction upon power stroke.

BRIEF DESCRIPTION OF DRAWINGS

Specific embodiments of the invention will be described in detail with reference to the following figures.

DETAILED DESCRIPTION

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Objects and Advantages

An object of the invention is to provide a swim fin profile with significantly less drag force.

Another object of the invention is to dramatically reduce a swim fin drag profile cross sectional area.

Yet another objective of the invention is provide an elastomeric hinge subjected up to a near 90° bending for an infinite fatigue cycle limit.

Another object of the invention is to create blade groove or channel cross section with geometries that function along a blade inline axis to provide sufficient flexibility to minimize upstroke profile without diminishing hardness properties to sustain an unfolded or unbent power sweep stroke area without collapsing the blade.

Another object of the invention is to create a swim fin that can efficiently utilize a flexible elastomeric inline hinge that can be economically manufactured.

Yet another objective of the invention is provide manufacturers of swim fins design alternatives for manufacturing an inline swim fin.

Another object of the invention is to create a swim fin that can efficiently utilize a unitary flexible elastomeric inline hinge.

Figure 1:
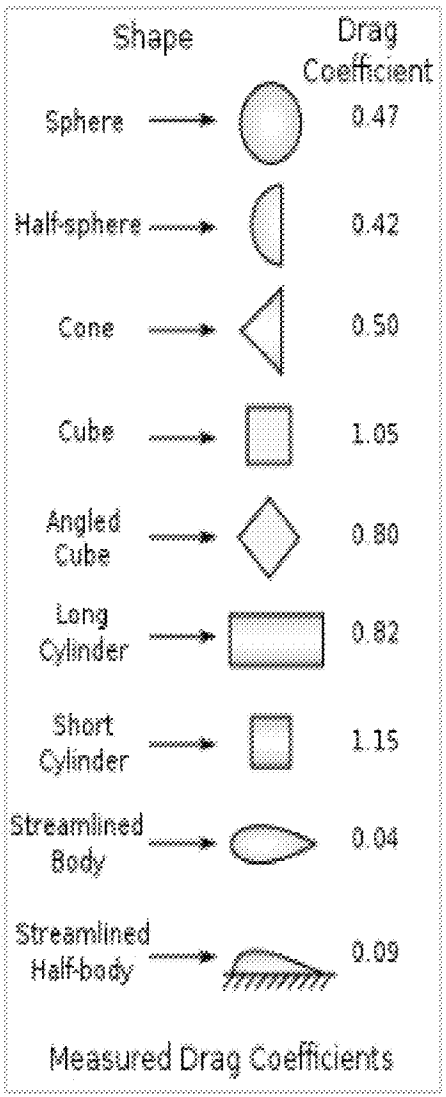
Prior Art FIG.1
FIG. 1 shows a prior art swim fin front side and top views respectively illustrating the transverse axis deflecting blade with a measured drag coefficients table.
Figure 1:
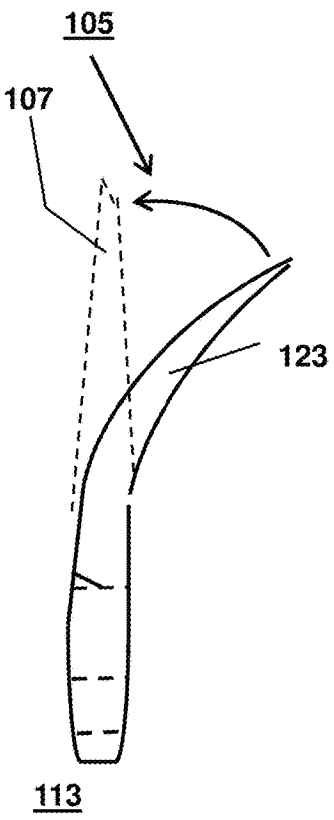
Prior Art FIG.1
Figure 1:
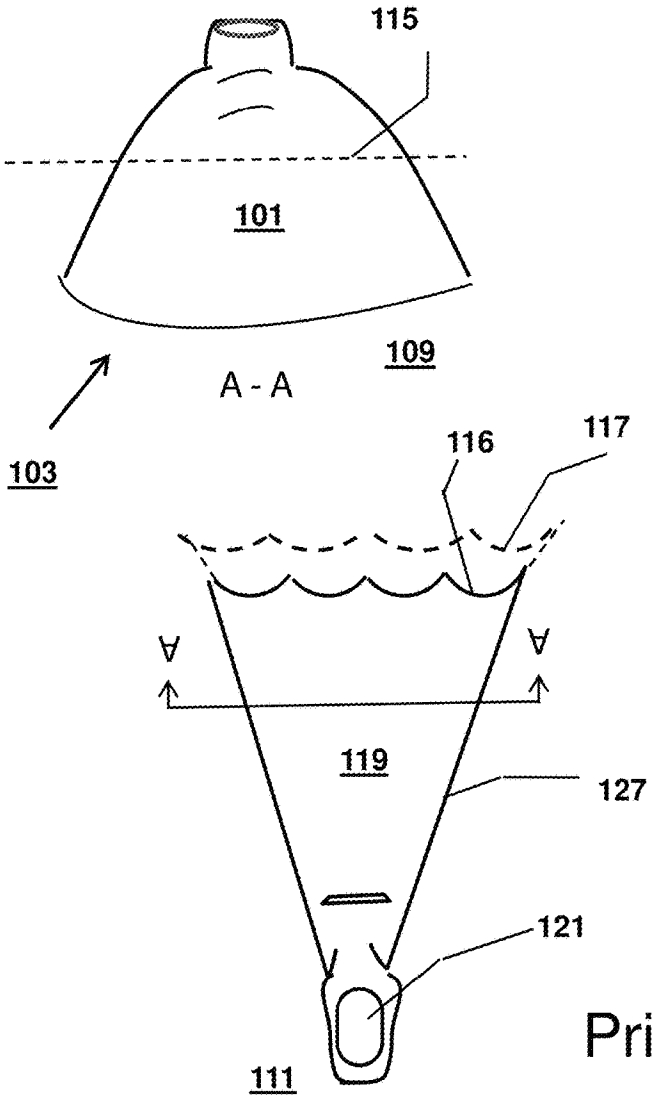
Prior Art FIG.1

FIG. 1 shows a prior art swim fin 109 113 111 front side and top views respectively illustrating the transverse axis 115 deflecting blade 101 123 119 with a measured drag coefficients table 125. The fluid vector 103 105 remains perpendicular to the upstroke blade 101 123 creating a drag coefficient, $C_d$=1.05, of a cube shape as shown table 125 or a flat plate profile (not shown) with $C_d$=1.28. The actual drag area 101 119 perpendicular to the relative velocity 103 will increase, from 116 to 117, in the course of the upstroke 105 start 123 to finish 107, thus also increasing the drag force, which includes the product of the drag coefficient, $C_d$, and the projected drag area perpendicular to the relative velocity.

Figure 2:
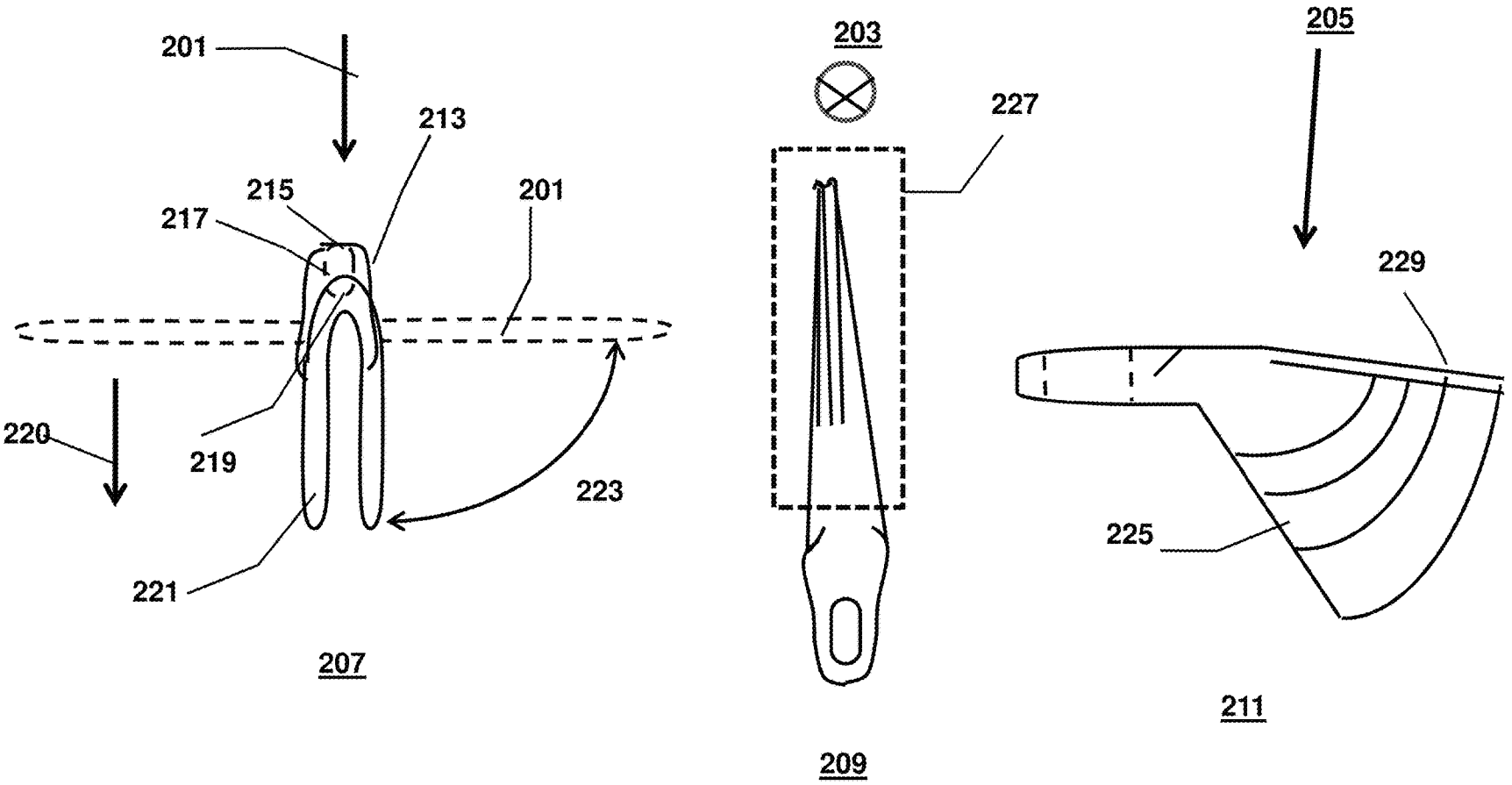
FIG. 2 illustrates an inline deflecting swim fin blade with minimal drag profile on upstroke in an embodiment of the invention.

FIG. 2 illustrates an inline deflecting swim fin blade with relatively minimal drag profile on upstroke in an embodiment of the invention. The inline fin front 207, top 209 and side 211 views are shown with respect to the relative velocity vector 201 front, 203 top and 205 side views respectively. Beginning the upstroke, the blade leaves 221 225 are held directly behind the foot-inline 215 centerline 219 229 perpendicular to fluid velocity vector 201 205 respectfully. This provides a minimum flow impending cross section for drag. The drag coefficient, $C_d$, for this shape streamlined body profile as shown in the table FIG. 1 125 is shown to be 0.04, substantially less than a blade bending about a blade's transverse axis as with a flat plate profile. Upon cessation of a foot-inline deflecting blade upstroke has a substantially smaller projected surface area 227, shown in the dotted box, for projected direct impinging fluid flow. At a blade start of the down or power stroke, the blade leaves 201 open 223 substantially perpendicular to and into the upstroke velocity vector 220 where the blade power stroke changes into the direction of maximum blade projected area for pushing fluid 220 away from the blade to provide fin lift or propulsion.

Figure 3:
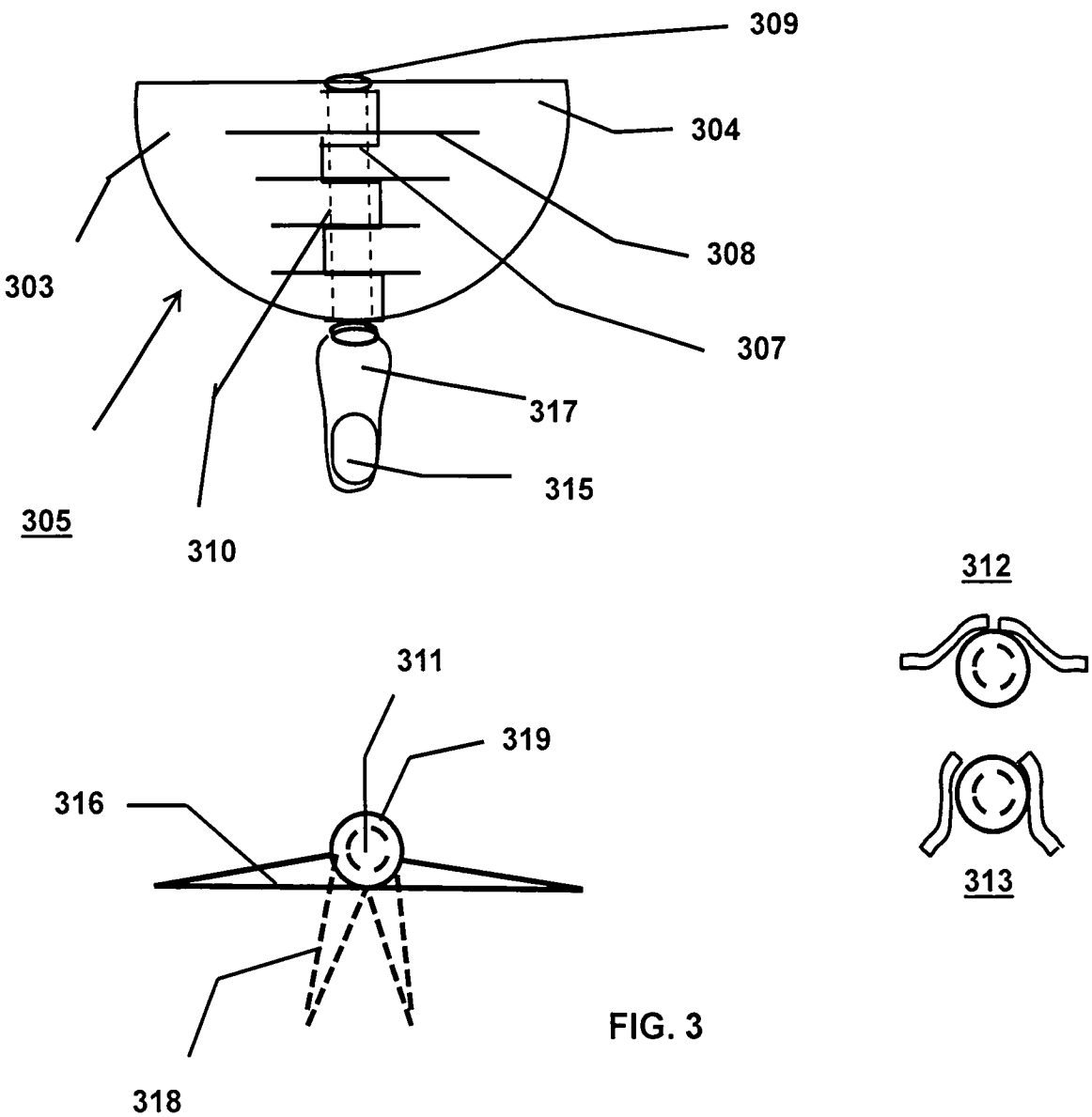
FIG. 3 shows a an inline deflecting swim fin top and front views using a swim fin integrated classic hinge design in an embodiment of the invention.

FIG. 3 shows a an inline deflecting swim fin top and front views using a swim fin integrated classic hinge 319 design in an embodiment of the invention. The swim fin blade 305 is coupled to a foot pocket 315 in a foot section 317 and integral to a swim fin foot blade having an embedded hinge. The hinge has several components to provide blade flexing along the foot axis. In an embodiment of the invention the hinge 319 consists of knuckles 307 and two fin blade leaves 303 304 rotatable to substantially 90°. about the inline hinge axis. The knuckle 307 has a pin 309 311 to secure coupling two leaves 303 304 which open 316 for onset of power stroke and close 318 upon blade upstroke. The blade 305 leaves 303 304 having embedded stops 308 with two ends rib-like rigidly coupled to the leaves 303 304 and rotatable coupled to the knuckles at one end, with stop ends engaging 312 leaves 303 304 rotatable to a blade co-planer configuration for a power stroke and disengaging stops 313 upon rotation to less than a co-planer 313 configuration for an up stroke to complete a two stroke cycle. All components parts can be made from the same or disparate materials including rubber, plastic, thermoplastic and or elastomeric. Component materials can have different hardness or stiffness properties to comply with the flexibility and rigidity required in a two stroke swim fin cycle.

A hinge component 311 connects two fin leaves 303 304 316 or wings, allowing only a limited angel of rotation between strokes. Two leaves 303 304 are coupled by a hinge and are able to rotate relative to each other about a fixed axis of rotation with respect to a foot axis, with rotations being prevented to the plane of the fin leaves 316 fully perpendicular to a stroke direction.

A barrel hinge consists of a sectional barrel 311 secured by a pivot. A barrel can be simply a hollow cylinder. A pin cap 309 or rod holds the leaves 303 304 together, inside the knuckle 307 or pintle. Knuckle 307, the hollow typically circular or oval deformed portion creating the joint of the hinge through which a pin 310 311 is set. The knuckles 307 319 of either fin leaf 303 304 typically alternate and interlock with the pin 310 passing through all of them. Two fin leaves 303 304 that extend laterally from the knuckle 307 and rotate freely around the pin 310 311 to an extent provided by stops 308.

The swim fin with a foot component 317 or compartment with a foot pocket 315 is coupled to a fin blade 305 having an embedded hinge 307 aligned with the inline foot axis. the embedded hinge 307 coupled to at least one leaf 304, the hinge disposed between the foot component 317 and a blade tip center 309. The leaves 304 316 318 are pivotally coupled to the hinge 308 319 and rotatable from an perpendicular fluid flow upon power stroke 315 to parallel fluid flow upon an upstroke 318. Embedded in the blade 305 is least one hinge-leaf pivot stop 308, limiting leaf 304 315 317 rotations from substantially parallel to a substantially perpendicular impinging flow direction.

In other embodiments, hinges can vary, having mechanical hinge components include hinges from a set of hinges including Barrel hinge, Butt hinge, Butterfly, Case hinges, Concealed hinge, Flag hinge, H hinge, Pivot hinge, Self-closing hinge, Bearing hinge and Spring hinge.

Figure 4:
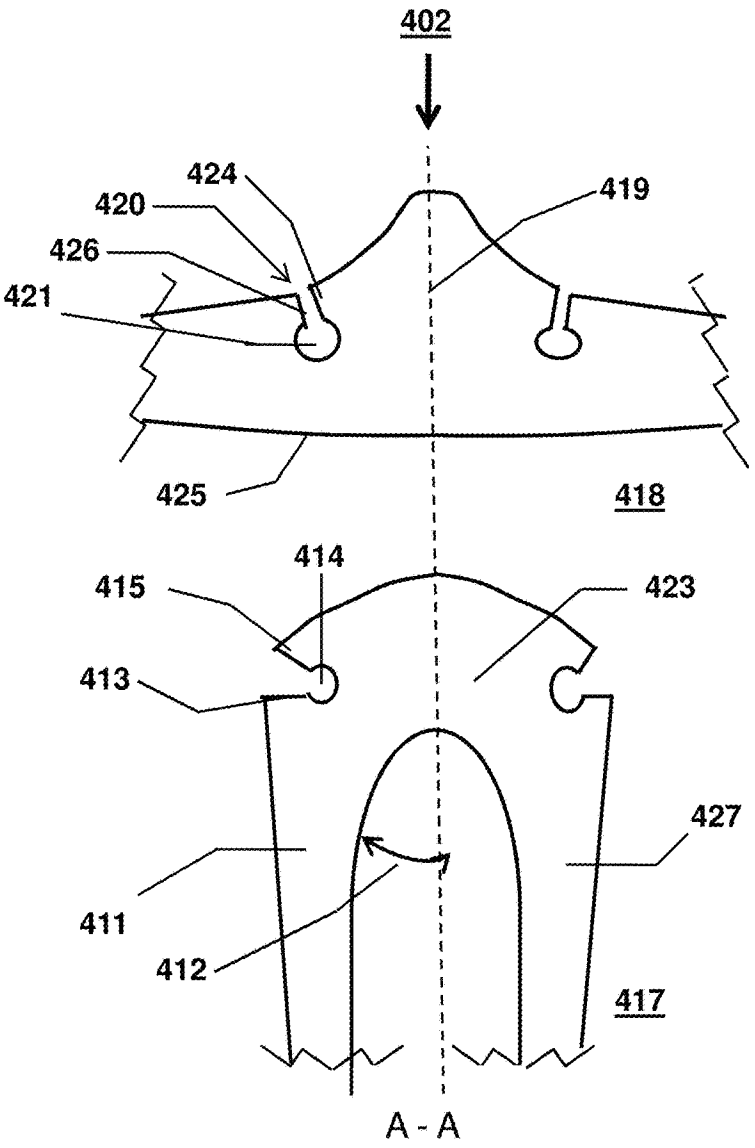
FIG. 4 shows an foot inline axis deflecting swim fin with a duel channel unitary elastomeric hinge design in an embodiment of the invention.
Figure 4:
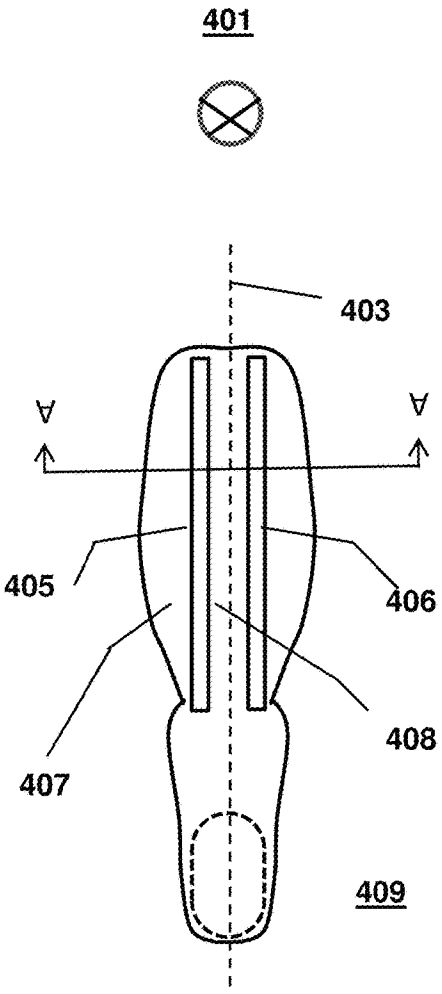

FIG. 4 shows an foot inline axis deflecting swim fin with a duel channel unitary elastomeric hinge design in an embodiment of the invention.

The top view of an inline deflecting fin 409 shows a hinge having two channel structures 405 406 substantially reflective about the foot-fin inline axis. These two groove-like channels 405 406 provide an embedded unitary elastomeric hinge rotatable about the inline fin blade axis 403. A hinge stop or limiter mechanism in each channel has an upper jaw stop 415 and lower jaw stop 413, shown in the fin channel cross section views 417 418 for a hinge flexed blade leaves 411 closed 417 and hinge leaves open 418. A two stroke fin action would generally place the relative blade velocity vector 401402 in a plane perpendicular to the two stroke action.

A channel flex stop mechanism has an opening 420 to a cavity 421 414, with a cross section that extrudes or extends laterally or parallel to the foot inline axis 403 along the hinge. The opening 420 or gap provides access to cavity 414 421 that unitarily supports flexibility of the fin hinge 423 without material strain or stretch about the cross sectional axis 419 through the opening and closing of the jaw stops 421 425 413 415 gap, in order to pivot the leaves 411 427 along the lateral or inline axis 403. The upper jaw stop 415 424 remains rigid while the lower jaw stop 413 421 respectively pivots the channel about the hinge axis 419 open. The blade leaves 411 427 act as protruded levers when channel cross section jaw stops 421 425 413 415 are 412 flexing open upon upstroke 417 and flexing closed 418 upon power stroke, allowing for lower jaw stop 413 426 to rotate forward in relation to upper stop 415 424 enlarging the opening 420 to provide flexure 412 with minimum material stretching or strain while minimizing the area perpendicular to projected flow 402.

In short, an embedded unitary elastomeric hinge 408 426 has at least one channel 405 406 with integrated limiter stops 413 415 426 424 with the channel 405 406 420 rotatably coupled laterally to at least one swim fin blade leaf 407 411 427 disposed along the channel 406 406, channel is aligned with the foot inline 403 and hinge axis 419, having a cross section rotation limiting stop mechanism 420 having a two jaw stop protrusions 413 415 426 424 across a gap 420, jaw stops 413 415 426 424 coupled by a isomeric hinge material cavity 414 421 cross section, channel cross section forming a flexible channel cavity 414 421 along the hinge axis 403 with the protruding jaw stop gap flexing open on fin blade up stroke 417 to provide hinge flexure without exceeding material elasticity properties and closing to maintain leaf-hinge position perpendicular to the flow direction upon power stroke 418.

Figure 5:
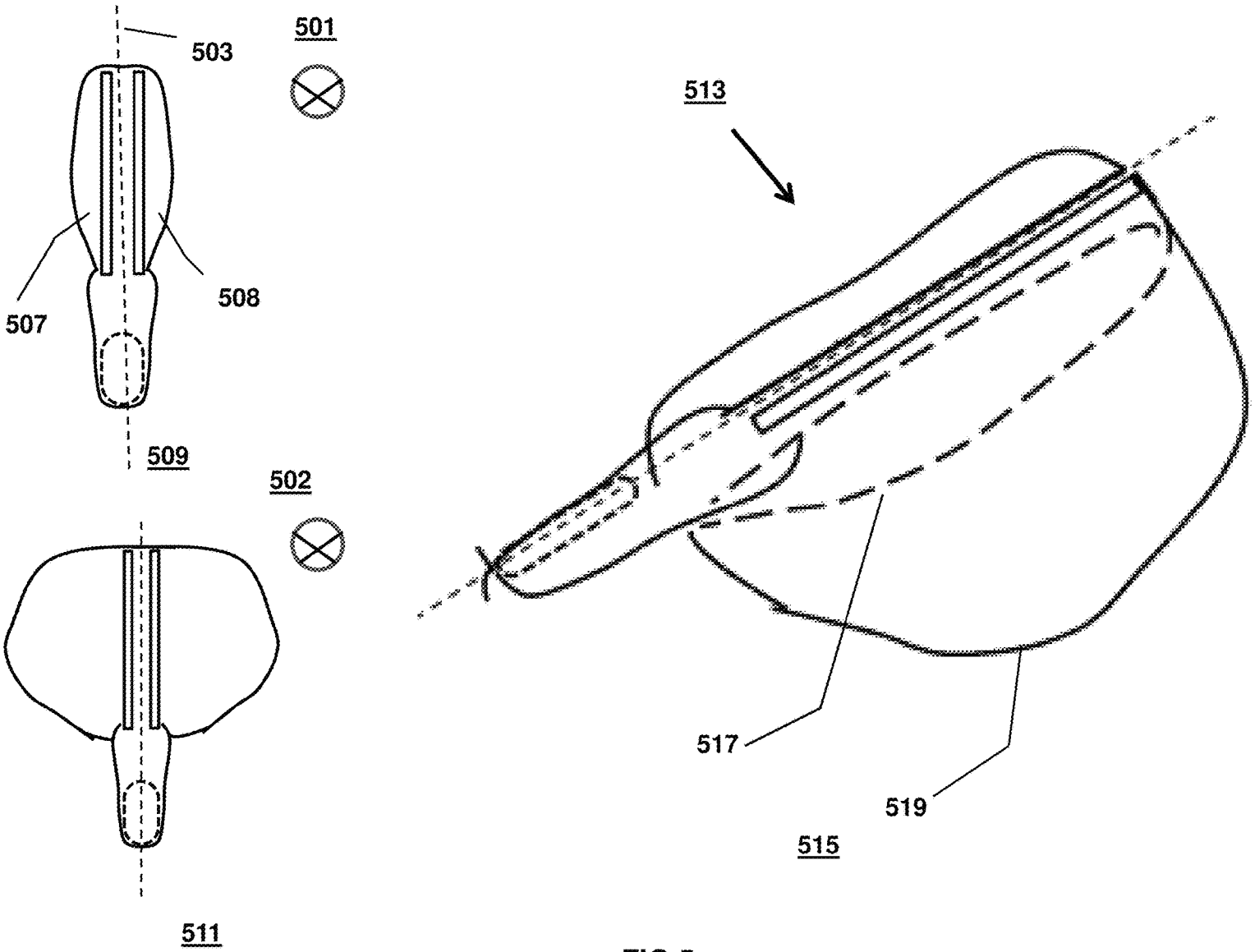
FIG. 5 shows a foot inline axis deflecting swim fin top views and perspective view in an embodiment of the invention.

FIG. 5 shows a foot inline axis deflecting swim fin top views and perspective view in an embodiment of the invention. Top view 509 shows the flow 501 projected area two leaf 507 508 blade configuration on an upstroke and top view 511 shows the flow 502 projected area for the down or power stroke. The perspective view 515 shows the blade leaves 519 517 flexing about the foot inline center and hinge axis. Material thickness, geometry can vary across the leave 517 519 thickness to facilitate flexing to streamline profile at up stroke 509 517 for minimum drag and accommodating blade stiffness requirements for the larger area moving fluid upon power stroke 511 519. Hinge stops maintain the flat plate blade profile on the power stroke with leaf stiffness maintained by the harder material, embedded stiffeners, leaf ribs or ridges or combinations.

Figure 6:
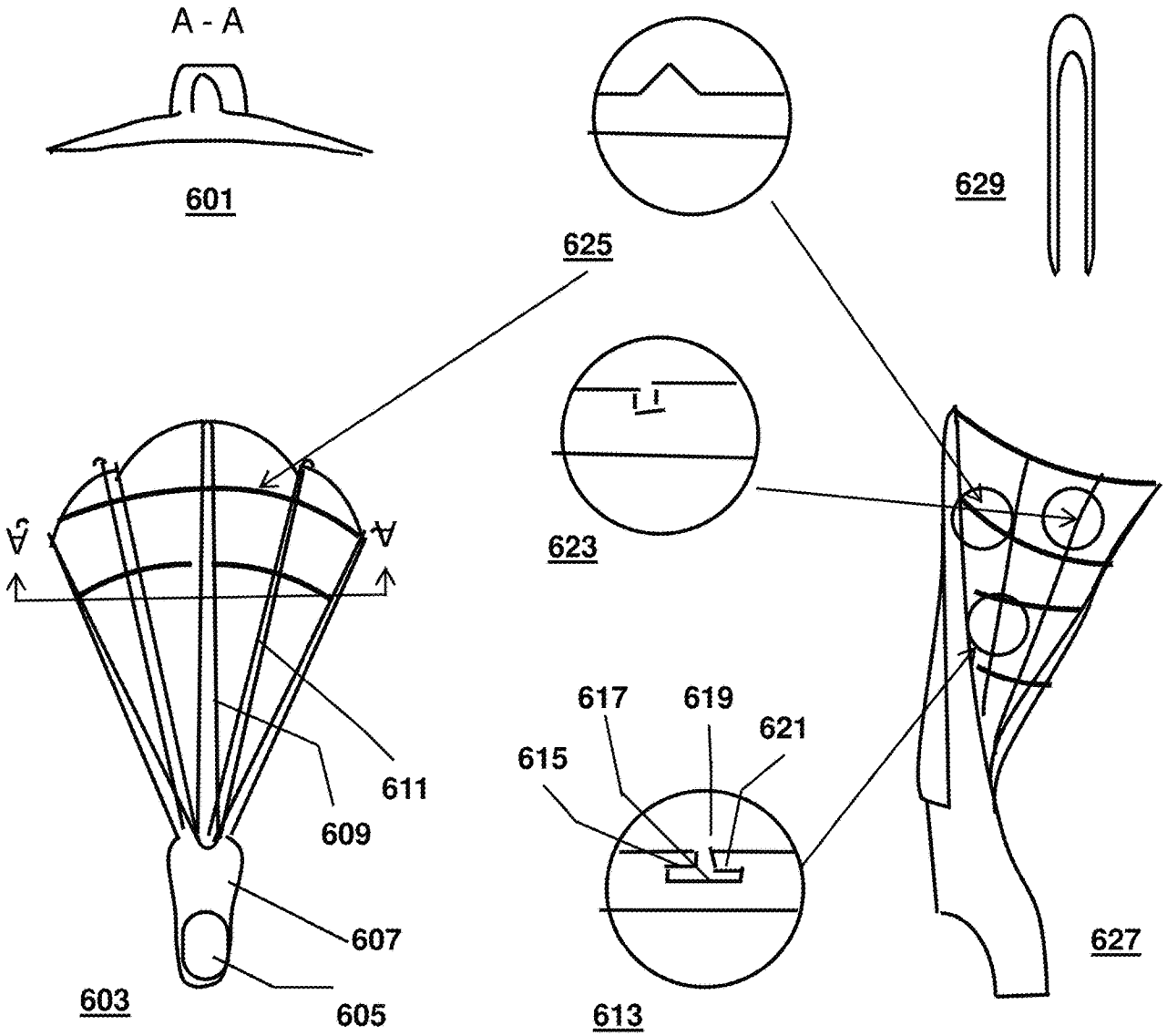
FIG. 6 shows an inline deflecting swim fin with alternate material-geometry hinge leaf blade artifacts for providing variable flexibility and material property hardness for designs in embodiments of the invention.

FIG. 6 shows an inline deflecting swim fin with alternate material-geometry hinge leaf blade artifacts for providing variable flexibility and material property hardness for designs in embodiments of the invention.

In an embodiment of the invention a flexible inline blade swim fin top 603, front 601 629 and a side 627 views with an inline flexing through an integrated or embedded elastomeric controlled flexible hinge 609. The swim fin includes a fin blade extending from or out of the front section 607 of the foot pocket 605. In an embodiment a swim fin may further include an adjustable heel strap as part of a foot compartment or foot component. The fin blade may further include side rails or load bearing ribs coupled to a foot pocket. A fin blade embodiment may further include a flexing hinge member disposed between foot and the blade tail end and integrated into a blade having two leaf components rotatably coupled to the hinge 609, with a leaf having freedom to rotate from a co-planer leaf flat plate blade configuration on a power stroke to with a blade to a substantially stream-line parallel to flow configuration 629. In an embodiment of the invention the entire swim fin may be formed of an elastomeric material.

Overall stiffness of the blade and or leaves can be controlled by materials with Shore Durometer ranges from 35-95. Alternatively, in other embodiments, inline blade flexure can be created through cross section 613 623 shape and geometry dimension changes for channel stiffness variability.

In one such embodiment, the first 615 jaw stop is such that when a swim blade leaf pivots parallel to flow for an upstroke, the second jaw stop moves away from the first jaw stop forming a gap without blade material strain resistance allowing the unitary hinge body and blade shape profile to reconfigure from a flat plate 601 power stroke to a much more streamlined wing configuration 629 for the upstroke without material deformation from the two stroke cycling. In another embodiment a flexible connecting section has a generally rectangular shaped channel cross section 623 which is thinner than jaw stop section and for allowing channel axis flexing about the channel.

In another embodiment blade leaves can have varying stiffness, Shore Durometer values nearing 100 but having a hinge 609 providing the leaf-blade flexure along the hinge 609. In yet another embodiment, load bearing ribs 625 having stiffning material structured cross sections 625 which can be made to stiffen leaf structure sufficient to sustain a flat co-planer leaf blade configuration 601 for a fin power stroke. A rib member 625 extending from the hinge 609 or foot compartment 607 and substantially along a leaf, each rib 625 composed of an elastomeric material having a Shore A hardness between 40 and 95 durometer. The rib is coupled contiguously to a leaf such that load is transferred from the leaf component to the rib and on to the hinge and foot component 607.

Components of a swim fin can be made from any flexible substance with memory such as rubber, urethane, nylon, plastic, titanium, and polyvinyl. It is also within the spirit and scope of the present invention for components to be made of flexible but strong plastic such as MYLAR®, polypropylene, composites or any other flexible material exhibiting the required stiffness and or flexibility characteristics. Blade leaf components of some embodiments can be made of more rigid material with larger Durometer or Shore Durometer scale hardness wherein the hinge component can provide the full 90° rotation or less required conforming to the actual fin stroke cycle frequency and power in the two stroke swim fin blade.

In one such embodiment, the first 615 jaw stop is such that when a swim blade leaf pivots parallel to flow for an upstroke, the second jaw stop moves away from the first jaw stop without blade material strain resistance allowing the integrated hinge body and blade shape profile to reconfigure from a flat plate 601 power stroke cessation to a much more streamlined wing profile configuration 629 for the upstroke without material deformation from the two stroke cycling. In another embodiment a flexible connecting section has a generally rectangular shaped channel cross section 623 which is thinner than jaw stop section and for allowing channel axis flexing about the channel.

In another embodiment blade leaves 601 can be very stiff, Shore Durometer values nearing 100 but having a hinge 609 providing the blade rigidity. In yet another embodiment, ribs 625 having material stiffening rib structure cross sections 625 can be made to stiffen leaf component structure sufficient to retain a flat co-planer blade configuration for a fin power stroke.

Components of a swim fin can be made from any flexible substance with memory such as rubber, urethane, nylon, plastic, titanium, and polyvinyl. It is also within the spirit and scope of the present invention for components to be made of flexible but strong plastic such as MYLAR®, polypropylene or any other flexible material exhibiting the required characteristics. Blade leaf components of some embodiments can me made of more rigid material with larger Durometer or Shore Durometer scale hardness wherein the hinge can provide the full 90° swing or less required conforming to the actual fin stroke cycle frequency and power in the two stroke swim fin blade.

The present invention discloses several embodiments for making an inline blade defecting swim fin. Furthermore in an aspect of the invention, material properties are a large factor in the mechanism of fin blade hinge alternatives. Moreover, elastomeric substances can be use to make various cross section channel or alternatively continuously varying hardness integration of elastomeric materials. In addition, there are many types of hinges, many of which can serve the invention purpose. The detailed description is not limited to any particular hinge construction, structure or material.

Therefore, while the invention has been described with respect to a limited number of embodiments, those skilled in the art, having benefit of this invention, will appreciate that other embodiments can be devised which do not depart from the scope of the invention as disclosed herein. Other aspects of the invention will be apparent from the following description and the appended claims.

What is claimed is:

1. An inline foot axis deflecting swim fin comprising:

a swim fin with a foot compartment;

a swim fin blade comprised of two leafs, the swim fin blade having an embedded hinge aligned with an inline foot axis said embedded hinge extending central to and coupled to a front end of the foot compartment;

the embedded hinge coupled to the leaves, the hinge disposed central to and between the foot compartment and a blade tip center;

the leaves pivotably coupled to the hinge and free to rotate from a position perpendicular a fluid flow upon swim fin power stroke and rotating to a parallel fluid flow for a swim fin upstroke;

at least one hinge-leaf pivot stop, limiting a leaf rotation from substantially parallel fluid flow direction to a substantially perpendicular leaf impinging fluid flow direction;

whereby the swim fin provides maximum fluid displacement on the power stroke and encounters minimum fluid drag upon leaf rotation parallel to fluid flow on the up stroke.

2. The inline foot axis deflecting swim fin as in claim 1 wherein the embedded hinge is selected from a set of hinges including Barrel hinge, Butt hinge, Butterfly, Case hinge, Concealed hinge, Flag hinge, H hinge, Pivot hinge, Self-closing hinge, Bearing hinge and Spring hinge.

3. The inline foot axis deflecting swim fin as in claim 1 wherein the embedded hinge is a unitary elastomeric hinge having at least one channel parallel to an inline foot axis with an integrated limiter stops integrated within the channel, that channel rotatably coupled laterally to at least one swim fin blade leaf disposed along the channel, the channel having a cross section rotation limiting stop mechanism formed from opposing jaw stop protrusions across a channel gap, the channel jaw stop protrusions made of an isomeric hinge material coupled with an integrated cavity, the channel cross section forming a flexible channel cavity along the hinge axis with the protruding jaw stop gap flexing open on fin blade up stroke to provide hinge flexure without exceeding material elasticity properties and closing to maintain leaf-hinge position perpendicular to the flow direction upon power stroke.

4. The inline foot axis deflecting swim fin as in claim 3 further comprising at least one embedded unitary elastomeric hinge channel with alternate shape open polygonal cross section with a gap, the open polygonal cross section with jaw stop gap extruding a channel into an axial cavity aligned with a hinge axis for providing a swim fin leaf stroke limited rotational flexure across the channel with jaw stop gap.

5. The inline foot axis deflecting swim fin as in claim 1 wherein components are made from a set of materials including rubber, urethane, nylon, plastic, titanium, polyvinyl, strong plastic, polypropylene, and composites.

6. The inline foot axis deflecting swim fin as in claim 1 further comprising the blade having at least one load bearing rib member made from surface protruding structured cross sections for adding stiffness to the swim fin blade sufficient to sustain a flat co-planer leaf blade configuration upon the power stroke, the rib member extending from a hinge or foot compartment substantially along and into a leaf, with each rib composed of sufficiently stiff material having a Shore A hardness between 40 and 99 durometer such that a blade surface load is transferred from the leaf component to the rib member for a flat plane configuration upon the power stroke.

7. A method for an inline foot axis deflecting swim fin comprising the steps of: providing a swim fin with a foot compartment;

coupling the foot compartment to a swim fin blade comprised of two leafs, with the swim fin blade having an embedded hinge aligned with an inline foot axis extending central to and from a front end of the foot compartment;

coupling the embedded hinge to the leaves, with the hinge disposed between the foot compartment and a blade tip center;

pivotably coupling the leaves to the hinge to allow the leaves to rotate from a perpendicular to fluid flow configuration upon power stroke to a parallel to fluid flow configuration on an upstroke, and providing at least one hinge-leaf pivot stop, for limiting leaf rotations from substantially parallel to a substantially perpendicular fluid impinging flow directions, such that the swim fin provides maximum fluid displacement on the power stroke with a flat plate configuration and encounters minimum fluid drag stream-line configuration upon leaf rotation parallel to the fluid flow on the upstroke.

8. The method for an inline foot axis deflecting swim fin as in claim 7 further comprising the step of selecting the embedded hinge from a set of hinges including Barrel hinge, Butt hinge, Butterfly, Case hinge, Concealed hinge, Flag hinge, H hinge, Pivot hinge, Self-closing hinge, Bearing hinge and Spring hinge.

9. The method for an inline foot axis deflecting swim fin as in claim 7 further comprising the step of providing the embedded hinge as an embedded unitary elastomeric hinge having at least one channel with integrated limiter stops with the channel rotatably coupled laterally to at least one swim fin blade leaf disposed along the channel, channel aligned with the foot inline and hinge axis, having a cross section rotation limiting stop mechanism having a two jaw stop protrusions across a gap, jaw stop protrusions coupled by a isomeric hinge material cavity cross section, channel cross section forming a flexible channel cavity along the hinge axis with the protruding jaw stop gap flexing open on fin blade up stroke to provide hinge flexure without exceeding material elasticity properties and closing to maintain leaf-hinge position perpendicular to the flow direction upon power stroke.

10. The method for an inline foot axis deflecting swim fin as in claim 7 further comprising the step of providing at least one embedded unitary elastomeric hinge channel with alternate shape open polygonal cross section having a gap, the open polygonal cross section extruding into an axial cavity aligned with a hinge axis providing limited rotational flexure across a channel jaw stop gap.

11. The method for an inline foot axis deflecting swim fin as in claim 7 further comprising the steps of providing components made from a set of materials including rubber, urethane, nylon, plastic, titanium, polyvinyl, strong plastic, polypropylene, and composites.

12. The method for an inline foot axis deflecting swim fin as in claim 7 further comprising the steps of providing the blade with at least one load bearing rib member with surface protruding structured cross sections made to stiffen a blade sufficient to sustain a flat co-planer leaf blade configuration upon the power stroke, said rib member extending from a hinge or foot compartment and substantially along a leaf, with each rib composed of sufficiently stiff material having a Shore A hardness between 40 and 99 durometer such that a blade surface load is transferred from the leaf component to the rib member.

* * * * *